US009419323B2

(12) United States Patent
Shinohara et al.

(10) Patent No.: US 9,419,323 B2
(45) Date of Patent: Aug. 16, 2016

(54) POWER COMBINER/DIVIDER OF A RADIAL LINE TYPE IMPEDANCE MATCHED BETWEEN A CENTER CONNECTOR AND PERIPHERAL OUTER CONNECTORS

(71) Applicant: Nihon Koshuha Co., Ltd., Yokohama-shi (JP)

(72) Inventors: Kibatsu Shinohara, Yokohama (JP); Yutaka Arizumi, Yokohama (JP)

(73) Assignee: Nihon Koshuha Co., Ltd., Yokohama-shi (JP)

( * ) Notice: Subject to any disclaimer, the term of this patent is extended or adjusted under 35 U.S.C. 154(b) by 0 days.

(21) Appl. No.: 14/347,387

(22) PCT Filed: Jan. 9, 2013

(86) PCT No.: PCT/JP2013/050148
§ 371 (c)(1),
(2) Date: Mar. 26, 2014

(87) PCT Pub. No.: WO2013/108674
PCT Pub. Date: Jul. 25, 2013

(65) Prior Publication Data

US 2014/0225679 A1 Aug. 14, 2014

(30) Foreign Application Priority Data

Jan. 19, 2012 (JP) ..... 2012-008921

(51) Int. Cl.
*H01P 5/12* (2006.01)
*H01P 5/18* (2006.01)

(52) U.S. Cl.
CPC . *H01P 5/12* (2013.01); *H01P 5/183* (2013.01)

(58) Field of Classification Search
CPC ..... H01P 5/12
USPC ..... 333/125, 136, 127
See application file for complete search history.

(56) References Cited

U.S. PATENT DOCUMENTS 4,035,746 A * 7/1977 Covington, Jr. ..... 333/127
4,684,874 A * 8/1987 Swift et al. ..... 333/125

(Continued)

FOREIGN PATENT DOCUMENTS

JP 05-175712 A 7/1993
JP 09-199913 A 7/1997

(Continued)

OTHER PUBLICATIONS

Notification of Reasons for Refusal mailed Jun. 26, 2014, issued for the Japanese patent application No. 2012-008921.

(Continued)

*Primary Examiner* — Benny Lee
(74) *Attorney, Agent, or Firm* — Locke Lord LLP

(57) ABSTRACT

A power combiner/divider W1 which includes: a body portion in which a cavity is formed; a center coaxial connector which is formed on an approximately center portion of the body portion; a plurality of peripheral coaxial connectors 14 which are arranged concentrically about the center coaxial connector 11 and are formed on the body portion; a radial line which is formed in the cavity formed in the body portion; a center coaxial line which has one end thereof connected to the center coaxial connector and the other end thereof connected to a center portion of the radial line; and a peripheral coaxial line which has one end thereof connected to the peripheral coaxial connector and the other end thereof connected to an outer peripheral portion of the radial line, an impedance conversion part is provided to the radial line in one or plural stages.

8 Claims, 3 Drawing Sheets

(56) References Cited

U.S. PATENT DOCUMENTS

| | | | | |
|---|---|---|---|---|
| 4,700,145 | A | 10/1987 | Yelland et al. | |
| 4,933,651 | A * | 6/1990 | Benahim et al. | 333/125 |
| 5,142,253 | A * | 8/1992 | Mallavarpu et al. | 333/127 |

FOREIGN PATENT DOCUMENTS

| | | | |
|---|---|---|---|
| JP | 10-270915 | A | 10/1998 |
| JP | 2007-180655 | A | 7/2007 |

OTHER PUBLICATIONS

Bunichi Oguchi, "Tsuuken Sousho 1, microwave or millimeter wave circuit," Edited by Electrical Communication Laboratories of Nippon Telegraph and Telephone Public Corporation, 1964, p. 318-325 and English translation thereof.

Dirk L L.de Villiers et al., "Design of a Ten-Way Conical Transmission Line Power Combiner", IEEE transactions on microwave theory and techniques, vol. 55, No. 2, Feb. 2007, pp. 302-308.

International Search Report dated Apr. 16, 2013, issued for PCT/JP2013/050148.

* cited by examiner

POWER COMBINER/DIVIDER OF A RADIAL LINE TYPE IMPEDANCE MATCHED BETWEEN A CENTER CONNECTOR AND PERIPHERAL OUTER CONNECTORS

TECHNICAL FIELD

The present invention relates to a power combiner/divider, and more particularly relates to a power combiner/divider for combining or dividing power in a VHF band, a UHF band, a microwave band or millimeter-wave band, for example.

BACKGROUND ART

As a power combiner, there has been known a power combiner in which Wilkinson-type couplers, directional couplers, hybrid couplers or the like are connected in multi-stages or a power combiner which uses radial lines and a power combiner which uses conical lines. When the power combiner is used by setting an input end as an output end and the output end as the input end, the power combiner functions as a power divider and hence, hereinafter, both "power combiner" and "power divider" are referred to as "power combiner/divider".

For example, patent literature 1 discloses a power combiner/divider which uses radial lines as a power combiner/divider used for large power. The power combiner/divider disclosed in patent literature 1 which uses the radial lines is explained in conjunction with FIG. 4. FIG. 4 is a view showing the schematic constitution of the power combiner/divider of the prior art which uses radial lines (a view showing the schematic constitution of the power combiner/divider described in patent literature 1).

As shown in the drawing, the power combiner/divider 100 includes a circular box-shaped case 104 which is formed of a top plate 104*a* having a circular shape as viewed in a plan view, a bottom plate 104*b* which faces the top plate 104*a* in an opposed manner, and a side plate 104*c* which covers outer peripheries of the top plate 104*a* and the bottom plate 104*b*. A center coaxial connector (center coaxial terminal) 101*a* is formed on a center portion of the top plate 104*a*, and a plurality of peripheral coaxial connectors (peripheral coaxial terminals) 101*b* are formed on an outer peripheral portion of the top plate 104*a* equidistantly. A conversion element (coaxial line) 102*a* which extends to the bottom plate 104*b* in the inside of the case 104 is connected to the center coaxial connector 101*a*. A conversion element (coaxial line) 102*b* which extends to the bottom plate 104*b* in the inside of the case 104 is connected to each peripheral coaxial connector 101*b*. A gap portion which is formed by the top plate 104*a*, the bottom plate 104*b* and the side plate 104*c* constituting the case 104 forms a radial line 103.

Further, the power combiner/divider 100 is configured to function as a power combiner when the center coaxial connector 101*a* is used as an output terminal and the peripheral coaxial connectors 101*b* are used as input terminals, and is configured to function as a power divider when the center coaxial connector 101*a* is used as the input terminal and the peripheral coaxial connectors 101*b* are used as the output terminals. When the power combiner/divider 100 functions as the power divider, for example, the power combiner/divider 100 is operated as follows. To be more specific, an incident wave from the center coaxial connector 101*a* is converted into a radial line mode from a coaxial TEM mode by the center conversion element 102*a*. A wave which is converted into a radial line mode propagates concentrically toward the outside from the center, and the wave is converted into the coaxial TEM mode from the radial line mode in the same manner by the peripheral conversion elements 102*b*, and is outputted to the respective peripheral coaxial connectors 101*b* at the same phase and equal amplitude.

Impedance Z of the radial line 103 of the power combiner/divider 100 is set, as expressed by the following formula (formula 1), proportional to a height of radial line 103, inversely proportional to a distance R from a center portion of the radial line 103. Assuming the number of combining (or the number of dividing) as N and impedance of the coaxial connector 101*a*, 101*b* as $Z_0$ in the power combiner/divider 100, impedance Z of the radial line 103 is expressed by the following formula (formula 2).

$$Z=\sqrt{(\mu/\epsilon)}\times H/(2\pi R)=\eta\times H/(2\pi R) \quad \text{(formula 1)}$$

H: height of radial line
η: natural impedance of medium (377Ω in this case)
R: distance from the center of radial line $$Z=Z_0/N \quad \text{(formula 2)}$$

Further, for example, non-patent literature 1 is disclosed a power combiner/divider which uses a conical line as a power combiner/divider used for large power.

The schematic constitution of the power combiner/divider disclosed in non-patent literature 1 which uses a conical line is explained in conjunction with FIG. 5. FIG. 5 is a view showing the schematic constitution of the power combiner/divider of the prior art which uses the conical, line (view showing the schematic constitution of the power combiner/divider disclosed in non-patent literature 1).

As shown in the drawing, the power combiner/divider 200 includes a body portion 204 having a circular shape as viewed in a plan view, and a center coaxial connector 201*a* which is formed on a center portion on one surface of the body portion 204. A plurality of peripheral coaxial connectors 201*b* are formed on an outer peripheral portion of the other surface of the body portion 204. A coaxial line 202*a* which extends to the inside of the body portion 204 is connected to the center coaxial connector 201*a*. Coaxial lines 202*b* which extend to the inside of the body portion 204 are connected to the peripheral coaxial connectors 201*b*. A gap portion indicated by symbol 203 in the drawing forms a conical line. In this power combiner/divider 200, the coaxial line 202*a* constitutes "¼ wavelength impedance converter", wherein "D1" in the drawing indicates an inner diameter of a coaxial line outer conductor, and "D2" in the drawing indicates an outer diameter of a coaxial line inner conductor.

Characteristic impedance ($Z1_0$) of the coaxial line 202*a* is set so as to satisfy the relationship expressed by the following formula 3 between the inner diameter (D1) of the coaxial line outer conductor and the outer diameter (D2) of the coaxial line inner conductor. Accordingly, the characteristic impedance ($Z1_0$) of the coaxial line 202*a* can be obtained based on the inner diameter (D1) of the coaxial line outer conductor and the outer diameter (D2) of the coaxial line inner conductor using the following formula 3.

$$Z1_0=60\ln D1/D2 \quad \text{(formula 3)}$$

CITATION LIST

Patent Literature

[patent literature 1]JP-A-5-175712 paragraphs 0002 and 0003, FIG. 6

[non-patent literature 1](in Dirk L L.de Villiers, two others, "Design of a Ten-Way Conical Transmission Line Power Combiner", IEEE transactions on microwave theory and techniques Vol 55, No. 2 (USA) February, 2007, p. 302-308)

[non-patent literature 2]"Tsuuken Sousho 1, microwave or millimeter wave circuit" written by Bunichi Oguchi, edited by Electrical Communication Laboratories of Nippon Telegraph and Telephone Public Corporation, published by Maruzen Ltd. 1964, p. 318-325)

SUMMARY OF THE INVENTION

Technical Problem

When the above-mentioned power combiner/divider of the prior art is able to have the constitution which makes possible the designing and manufacture of the power combiner/divider which can easily realize required performance such as required frequency band width, a manufacturing cost can be lowered so that the constitution becomes extremely useful. However, the above-mentioned power combiner/divider of the prior art does not have such a constitution which enables the above-mentioned designing and manufacture of the power combiner/divider.

To be more specific, in the power combiner/divider 100 shown in FIG. 4, it is necessary to provide an impedance converter having the constitution where impedance on an input end side of the radial line 103 takes the value "Z (see (formula 1), (formula 2))" as viewed from an input end side. However, in patent literature 1, there is no disclosure of an impedance converter having the constitution which takes into account a frequency band width or the like.

Further, in the power combiner/divider 200 shown in FIG. 5, the impedance converter is provided only to the coaxial line 202*a*, when the number of combining (or the number of dividing) becomes large, there arises a technical drawback that the designing and manufacture of the power combiner/divider 200 become difficult. For example, in the above-mentioned power combiner/divider 200, when characteristic impedance of an output end of "¼ wavelength impedance converter" is set to a value which matches 50Ω and the number of combining N is set to 100 (N=100), impedance of the conical line 203 is matched to "0.5Ω" based on a logic described in non-patent literature 2, and characteristic impedance of an input end of "¼ wavelength impedance converter" is determined (characteristic impedance of the input end of the coaxial line 202*a* is determined).

An N-type connector is used in the power combiner/divider 200, and "the inner diameter (D1) of the coaxial line outer conductor is 7 mm" and hence, when "the outer diameter (D2) of the coaxial line inner conductor" is obtained using the above-mentioned (formula 3), "the outer diameter (D2) of the coaxial line inner conductor becomes 6.94 mm". In this case, a distance between the inner conductor and the outer conductor of the coaxial line 202*a* ((D1−D2)/2) becomes "0.03 mm" and hence, the manufacture of the power combiner/divider 200 becomes substantially impossible. That is, in the power combiner/divider 200, when the number of combining is increased (for example, N=100), the distance between the inner conductor and the outer conductor of the coaxial line 202*a* ((D1−D2)/2) becomes extremely small so that the manufacture of the power combiner/divider 200 becomes virtually impossible.

In the power combiner/divider 200, it may be possible to make use of a "20D connector" or a "39D connector" having a larger size than the N-type connector in place of the N-type connector. However, the difficulty in manufacture also cannot be overcome in this case. For example, even when the 39D connector having the larger size of these connectors (the 20D connector, the 39D connector) is used, assuming characteristic impedance of an input end of the coaxial line 202*a* as "0.5Ω", "the outer diameter (D2) of the inner conductor becomes 38.47 mm" for "the inner diameter (D1) of the outer conductor becomes 38.79 mm". Also in this case, the distance ((D1-D2)/2) between the inner diameter (D1) of the outer conductor and the outer diameter (D2) of the inner conductor becomes "0.16 mm" and hence, the manufacture of the power combiner/divider 200 becomes extremely difficult.

The present invention has been made in view of the above-mentioned technical drawbacks, and it is an object of the present invention to provide a power combiner/divider having the constitution which enables the designing and manufacture of the power combiner/divider which can easily realize required performance such as required frequency band width.

Solution to Problem

To overcome the above-mentioned drawbacks, according to one aspect of the present invention, there is provided a power combiner/divider which includes: a body portion in which a cavity is formed; a center coaxial connector which is formed on an approximately center portion of the body portion; a plurality of peripheral coaxial connectors which are arranged outside the center coaxial connector concentrically with the center coaxial connector, and are formed on an outer peripheral portion side of the body portion; a radial line which is formed in the cavity formed in the body portion; a center coaxial line which has one end thereof connected to the center coaxial connector and the other end thereof connected to a center portion of the radial line; and a peripheral coaxial line which has one end thereof connected to the peripheral coaxial connector and the other end thereof connected to an outer peripheral portion of the radial line, wherein the peripheral coaxial line is provided for every peripheral coaxial connector, the power combiner/divider is configured to function as a power combiner when the center coaxial connector is used as an output terminal and the peripheral coaxial connector is used as an input terminal, and is configured to function as a power divider when the center coaxial connector is used as the input terminal and the peripheral coaxial connector is used as the output terminal, and an impedance conversion part is provided to the radial line in one or plural stages, and the impedance conversion part is configured to perform impedance matching between the input terminal and the output terminal.

In this manner, according to the present invention, in the power combiner/divider, the impedance conversion part is provided to the radial line in one or plural stages and hence, compared to the above-mentioned prior art, the designing and manufacture of the power combiner/divider which can easily realize required performances can be made. To be more specific, the impedance of the radial line is relevant to a height (H) of the radial line, and a distance (R) from the center of the radial line and hence, it is possible to provide the impedance conversion part in the radial line by adjusting the height (H) and the distance (R) (by designing the height (H) and the distance (R) to proper values). Then, the height (H) and the distance (R) are sizes which are sufficiently large compared to a distance between an inner conductor and an outer conductor of the coaxial line and hence, according to the present invention, there is no possibility that the designing and manufacture of the power combiner/divider will become difficult different from the above-mentioned power combiner/divider 200 described in non-patent literature 1. Particularly, by adopting "¼ wavelength multi-stage impedance conversion part" disclosed in non-patent literature 2 as the impedance conversion part, the designing and manufacture of the power combiner/divider which can easily realize required performances can be made.

Further, it is preferable that an impedance conversion part is provided to the center coaxial line in one or plural stages.

The reason such a constitution is adopted is as follows. That is, in the power combiner/divider, to acquire a large band characteristic, it is necessary to increase the number of stages of the impedance conversion part provided to the radial line. However, when the size of the power combiner/divider per se is limited, the number of stages of the impedance conversion part cannot be increased. This is because when the number of stages is increased, the size of the power combiner/divider will become large. In view of the above, by arranging the impedance conversion part both at the radial line and at the center coaxial line which is connected to the radial line, even when the size of the power combiner/divider is limited, the power combiner/divider can acquire advantageous effects substantially equal to the above-mentioned advantageous effects.

Further, it is preferable that an impedance conversion part is provided to said each peripheral coaxial line in one or plural stages.

The reason such a constitution is adopted is as follows. That is, the height of the radial line and the number of combining (or the number of dividing) have the inverse proportional relationship and hence, when the number of combining becomes large, the height of the radial line becomes extremely small so that a manufacturing (working) error will influence a characteristic of the radial line. On the other hand, the height of the radial line and the impedance of the radial line have the proportional relationship. Accordingly, the impedance conversion part is provided to the peripheral coaxial line, characteristic impedance of an output end of the peripheral coaxial line is set higher than characteristic impedance of an input end of the peripheral coaxial line, and impedance of an input end of the radial line is increased thus setting the height of the input end of the radial line higher. Accordingly, even when the number of combining of the power combiner/divider becomes large, the height of the input end of the radial line can be set high and hence, the occurrence of a manufacturing (working) error can be prevented.

Further, it is preferable that a high impedance part is arranged parallel to the peripheral coaxial line at a connecting portion between the peripheral coaxial line and the radial line.

By providing the high impedance part as described above, the generation of undesired reactance can be prevented and hence, the influence exerted by a manufacturing error (irregularities of performance or the like) can be suppressed.

Advantageous Effects of Invention

According to the present invention, it is possible to provide a power combiner/divider having the constitution which enables the designing and manufacture of the power combiner/divider which can easily realize required performance such as required frequency band width.

DETAIL DESCRIPTION OF PREFERRED EMBODIMENTS

Hereinafter, the power combiner/divider according to the respective embodiments of the present invention is explained in conjunction with drawings. In these embodiments, for the sake of convenience of explanation, an example where a power combiner/divider is used as a power combiner is given. Also in the explanation of this embodiment, formulae and symbols indicating height, distance and the like used in these embodiments are equal to those explained above in conjunction with the prior art.

<<First embodiment>>

Figure 1:
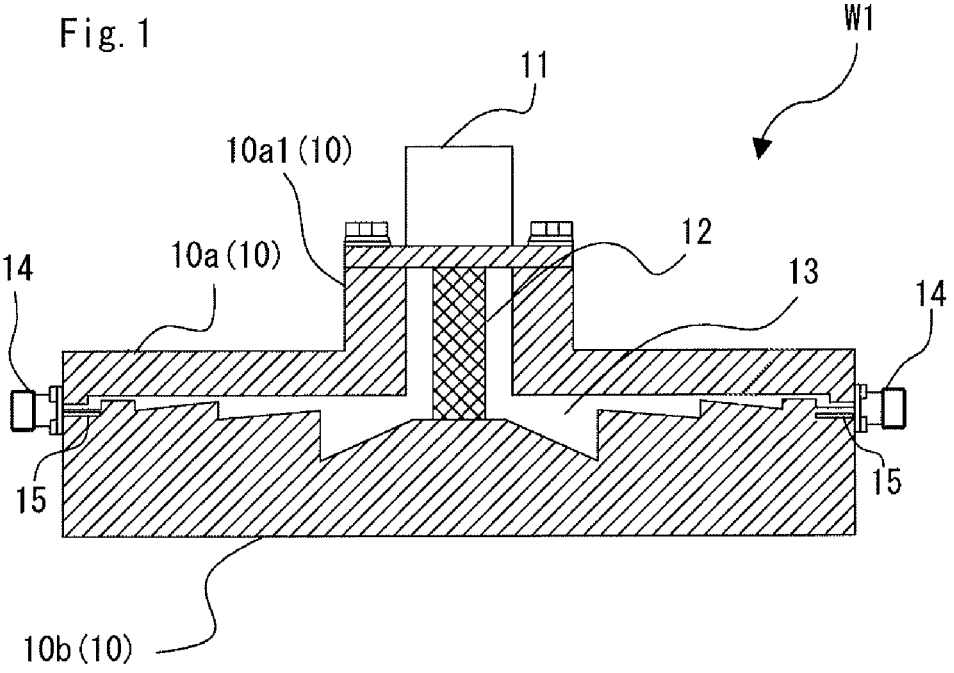
FIG. 1 is a schematic view showing a cross section of a power combiner/divider according to a first embodiment of the present invention.
Figure 2:
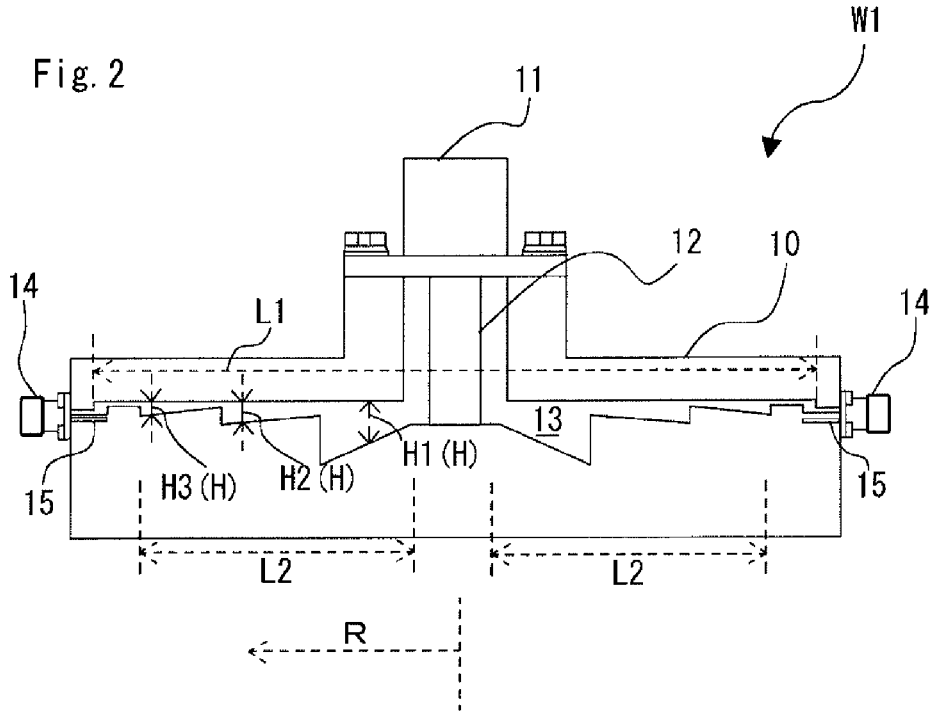
FIG. 2 is schematic view for explaining sizes specific to the power combiner/divider according to the first embodiment of the present invention.

Firstly, the power combiner/divider according to the first embodiment of the present invention is explained in conjunction with FIG. 1 and FIG. 2. The power combiner/divider W1 of the first embodiment is characterized by an impedance conversion part provided to a radial line 13. The principal of combining or dividing power is equal to the conventionally known principle. Accordingly, the above-mentioned technical feature is explained in detail, while the constitutions other than the above-mentioned technical feature are explained in a simplified manner.

As shown in the drawing, the power combiner/divider W1 of the first embodiment includes: a body portion 10 in which a cavity is formed; a center coaxial connector 11 which is formed on a center portion on one surface (upper surface) of the body portion 10; a plurality of peripheral coaxial connectors 14 which are formed on an outer peripheral portion of the body portion 10; a radial line 13 which is formed of a cavity formed in the inside of the body portion 10; a center coaxial line 12 which is formed on the center portion of the body portion 10; and a plurality of peripheral coaxial lines 15 which are formed on an outer peripheral portion of a radial line 13. The peripheral coaxial connectors 14 are arranged outside the center coaxial connector 11 and concentrically around a center portion of the center coaxial connector 11 equidistantly. Further, the cavity formed in the inside of the body portion 10 is formed into a circular shape as viewed in a plan view ranging from a center portion to the outer peripheral portion of the body portion 10.

Further, the center coaxial line 12 has one end thereof connected to the center coaxial connector 11 and the other end thereof connected to a center portion of the radial line 13. Further, the peripheral coaxial line 15 has one end thereof connected to the peripheral coaxial connector 14 and the other end thereof connected to an outer peripheral portion of the radial line 13. The peripheral coaxial line 15 is provided for every peripheral coaxial connector 14, and the number of peripheral coaxial lines 15 is equal to the number of peripheral coaxial connectors 14 (the number of combining N). That is, in the power combiner/divider W1, N pieces of peripheral coaxial connectors 14 are connected in parallel.

The body portion 10 is constituted of "a lid body portion 10*a* and a box body portion 10*b*" which are formed using a conductor as shown in FIG. 1. Further, the lid body portion 10*a* is formed into a circular shape as viewed in a plan view, and a cylindrical projecting portion 10*a*1 (FIG. 1) which projects toward one side (an upper side in FIG. 1 and FIG. 2) is formed on a center portion of the lid body portion 10*a*. An upper end portion of the projecting portion 10*a*1 is closed, and the center coaxial connector 11 is provided to the upper end portion. The center coaxial line 12 which has one end thereof connected to the center coaxial connector 11 passes through an inner cylindrical side of the cylindrical projecting portion 10*a*1. The center coaxial line 12 which passes through the inner cylindrical side of the projecting portion 10*a*1 extends to a center portion of the box body portion 10*b* on an upper surface side. Although the body portion 10 is formed of the lid body portion 10*a* and the box body portion 10*b* in this embodiment, the present invention is not particularly limited to such a constitution. For example, the body portion 10 may be constituted of an integrally formed part.

The box body portion 10*b* has a circular shape as viewed in a plan view (being formed into a circular shape having the same diameter as the lid body portion 10*a*). The box body portion 10*b* has one surface (upper surface) thereof recessed in a concave shape, and the other surface (lower surface) thereof formed into a planar shape thus forming a bottom portion. On the upper surface having a concave shape, stepped portions are formed concentrically from a center portion of the box body portion 10*b*. In this embodiment, a circular center portion is formed at the center portion of the upper surface, and the stepped portions are concentrically formed on the outer periphery of the circular center portion in 3 stages.

The upper surface of the box body portion 10*b* and a lower surface of the lid body portion 10*a* are arranged to face each other in an opposed manner, and the lid body portion 10*a* is placed on and fixed to the upper surface of the box body portion 10*b* thus forming the body portion 10 having a circular box shape as viewed in a plan view. The cavity having the stepped portions is formed in the inside of the body portion 10 by the lower surface of the lid body portion 10*a* and the upper surface (the upper surface on which the stepped portions are formed) of the box body portion 10*b*. The cavity having the stepped portions forms the radial line 13, and an impedance conversion part is formed. The impedance conversion part performs impedance matching between the peripheral coaxial connector (input end) 14 and the center coaxial connector (output end) 11. A range indicated by symbol "L1" shown in FIG. 2 indicates a range of the radial line 13 in the radial direction. A range indicated by symbol "L2" indicates a range of the impedance conversion part provided in the radial line 13 in the radial direction.

Further, in this embodiment, a case is exemplified where all of the center coaxial connector 11, the peripheral coaxial connector 14, the center coaxial line 12 and the peripheral coaxial line 15 have the same characteristic impedance of "50Ω". Further, in this embodiment, the peripheral coaxial lines 15 having characteristic impedance of "50Ω" are connected in parallel with the same number of combining N and hence, the impedance of an input end of the radial line 13 becomes ((50/N)Ω).

On the other hand, the impedance of an output end of the radial line 13 is connected to the center coaxial line 12 having characteristic impedance of 50Ω and hence, it is necessary to set the impedance of the output end of the radial line 13 to "50Ω".

In this manner, in this embodiment, the impedance conversion part provided to the radial line 13 is designed to convert impedance from "(50/N)Ω" to "50Ω".

Although the constitution of the impedance conversion part provided to the radial line 13 is not particularly limited, it is desirable that the impedance conversion part adopts the constitution such as "Chebyshev ¼ wavelength multi-stage type" or "maximally flat ¼ wavelength multi-stage type". This is because by adopting the constitution of the impedance conversion part of a ¼ wavelength multi-stage type, the impedance conversion part can be designed to acquire a matching condition within a required frequency band width. In this embodiment, the impedance conversion part is constituted of ¼ wavelength portions in 3 stages. The principle of the impedance conversion part of a ¼ wavelength multi-stage type is disclosed in the above-mentioned non-patent literature 2 and hence, the detailed explanation is omitted.

As described in the above-mentioned (formula 1), impedance (Z) of the radial line 13 is decreased toward the outer peripheral portion from the center portion of the radial line 13 inversely proportional to a distance R from the center portion of the radial line 13 as shown in FIG. 2. Accordingly, when the impedance conversion part in plural stages is provided to the radial line 13, impedance does not become constant within a range of "¼ wavelength" in respective stages of the impedance conversion part thus giving rise to a drawback that the designing of the impedance conversion part becomes complicated.

Accordingly, in this embodiment as shown in FIG. 2, "the height (H) of the radial line 13" is increased proportional to "the distance (R) from the center portion of the radial line 13" such that the impedance of each stage becomes constant within a range of "¼ wavelength" thus facilitating the designing and manufacture of the impedance conversion part whereby the above-mentioned drawback can be overcome.

To be more specific, as shown in FIG. 2, in the first-stage stepped portion adjacent to the center portion of the radial line 13, the height (H1) is set to be increased proportional to the distance (R) from the center portion of the radial line 13. Also in the second-stage stepped portion from the center portion of the radial line 13, the height (H2) is designed to be increased proportional to the distance (R) from the center portion of the radial line 13. In the same manner, also in the third-stage stepped portion from the center portion of the radial line 13, the height (H3) is designed to be increased proportional to the distance (R) from the center portion of the radial line 13. In this manner, according to this embodiment, the above-mentioned drawback can be overcome by setting the height (H) corresponding to the distance (R) for every stage.

The size of the impedance conversion part depends on frequency (wavelength). For example, the size of the impedance conversion part becomes "75 mm" in case of a microwave band (3GHz, wavelength=100 mm), and becomes "25 mm" in case of a millimeter wave band (9GHz, wavelength=33.3 mm).

As a factor employed for determining the size of the power combiner/divider W1, besides frequency (wavelength), a size of a flange of the coaxial connector (peripheral coaxial connector 14) which constitutes an input end is named. Although it depends on inputted power, in general, an "N type" coaxial connector or a "SMA type" coaxial connector is used as the coaxial connector of the power combiner/divider W1. A flange size of the "N type" coaxial connector is "25 mm", and a flange size of the "SMA type" coaxial connector is "13 mm".

Figure 5:
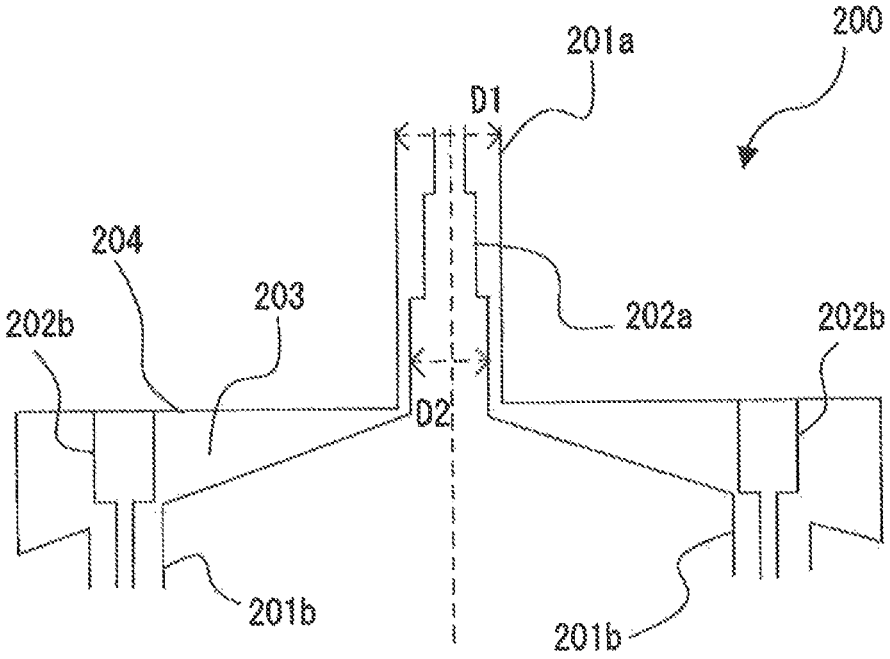
Fig. 5 Related Art
FIG. 5 is a view showing the schematic constitution of a power combiner/divider of the related art which uses a conical line.

For example, assuming the number of combining N to "50(100)", when the "N type" coaxial connectors (peripheral coaxial connectors 14) are continuously arranged on the same circumference, a radius of the power combiner/divider W1 becomes approximately "200 mm (400 mm)". Further, assuming the number of combining N to "50 (100)", when the "SMA type" coaxial connectors (peripheral coaxial connectors 14) are continuously arranged on the same circumference, a radius of the power combiner/divider W1 becomes approximately "105 mm (210 mm)". These sizes are sufficient for providing the impedance conversion part to the radial line 13 and hence, these sizes are not sizes which make the designing and manufacture of the power combiner/divider difficult different from the above-mentioned power combiner/divider 200 of the prior art (see FIG. 5).

As has been explained heretofore, according to the first embodiment of the present invention, the impedance conversion part is provided to the radial line 13 and hence, compared to the above-mentioned prior art, the designing and manufacture of the power combiner/divider which can easily realize required performances can be made. To be more specific, "the height (H) of the radial line 13" and "the distance (R) from the center portion of the radial line 13" are sufficiently large compared to the distance between the inner conductor and the outer conductor of the coaxial line and hence, there is no possibility that the designing and manufacture of the power combiner/divider becomes difficult different from the above-mentioned power combiner/divider 200 of the prior art (see FIG. 5). Particularly, in the first embodiment, the impedance conversion part is constituted of "¼ wavelength multi-stage-type impedance conversion part" and "the height (H) of the radial line 13" is increased proportional to "the distance (R) from the center portion of the radial line 13" such that the impedance of each stage becomes constant within a range of "¼ wavelength" thus facilitating the designing and manufacture of the impedance conversion part whereby the required performance can be realized.

<<Second Embodiment>>

Next, the second embodiment of the present invention is explained. The second embodiment is an embodiment obtained by partially modifying the constitution of the first embodiment and hence, for the sake of convenience of explanation, the constitutions of this embodiment identical to (and corresponding to) the constitutions of first embodiment are explained using the same symbols. Further, in the explanation of the second embodiment, parts which make this embodiment differ from the above-mentioned first embodiment are explained mainly and the explanation of the constitution of this embodiment similar to the constitution of the first embodiment is simplified.

To acquire a large band characteristic in the above-mentioned first embodiment, it is necessary to increase the number of stages of "¼ wavelength multi-stage-type impedance conversion part" provided to a radial line 13. In this case, although the size of the power combiner/divider W1 of the first embodiment becomes large, this constitution has a drawback that the constitution cannot cope with a case that the size of the power combiner/divider W1 is limited.

Accordingly, the second embodiment overcomes the above-mentioned drawback by arranging "¼ wavelength multi-stage-type impedance conversion part" on both a radial line 13 and a center coaxial line 12 which follows the radial line 13 in a dividing manner in the power combiner/divider W1.

To be more specific, in the power combiner/divider W1 of the second embodiment, in addition to the constitution of the first embodiment, the "¼ wavelength multi-stage-type impedance conversion part" is also provided to the center coaxial line 12. The number of stages of the "¼ wavelength multi-stage-type impedance conversion part" provided to the radial line 13 and the number of stages of the "¼ wavelength multi-stage-type impedance conversion part" provided to the center coaxial line 12 are determined by taking into account the allowable size of the power combiner/divider W1, the characteristic impedance of an input end of the center coaxial line 12 and the like (that is, the outer diameter of the inner conductor/the inner diameter of the outer conductor of the center coaxial line 12).

In this manner, the second embodiment can acquire advantageous effects substantially equal to the advantageous effects of the above-mentioned first embodiment. Further, according to the second embodiment, by arranging "¼ wavelength multi-stage-type impedance conversion part" on both the radial line 13 and the center coaxial line 12 which follows the radial line 13 in a dividing manner, this embodiment can cope with the case where the size of the power combiner/divider W1 is limited or the like.

<<Third Embodiment>>

Next, the third embodiment of the present invention is explained. The third embodiment is an embodiment obtained by partially modifying the constitution of the first embodiment or the second embodiment and hence, for the sake of convenience of explanation, the constitutions of this embodiment identical to (and corresponding to) the constitutions of the first embodiment are explained using the same symbols. Further, in the explanation of the third embodiment, parts which make this embodiment differ from the first embodiment are explained mainly and the explanation of the constitution of this embodiment similar to the constitution of the first embodiment is simplified.

In the power combiner/divider (for example, the power combiner/divider W1 of the first embodiment) which uses a radial line, the height (H) of the radial line and the number of combining (N) have the inverse proportional relationship ($H=(Z_0 \cdot 2\pi \cdot R)/(N \cdot \rho)$). Accordingly, when the number of combining (N) is increased, the height of the radial line 13 becomes extremely low so that a manufacturing (working) error influences a characteristic of the radial line 13. For this reason, the power combiner/divider W1 of the first embodiment (and the second embodiment) has a drawback that extremely high working accuracy is required when the number of combining (N) becomes large.

In the third embodiment, an impedance conversion part is provided to a plurality of peripheral coaxial lines 15 respectively so that characteristic impedance of an output end of the peripheral coaxial line 15 is set higher than characteristic impedance of an input end of the peripheral coaxial line 15 thus overcoming the above-mentioned drawback. The constitutions of the third embodiment are substantially equal to the constitutions of the first embodiment (and the second embodiment) except for the constitution that the impedance conversion part is provided to the plurality of peripheral coaxial lines 15 respectively.

To be more specific, in the power combiner/divider W1 of the first embodiment (and the second embodiment), the characteristic impedance of the peripheral coaxial line 15 connected to the input end of the radial line 13 is set to the same value as the characteristic impedance of the peripheral coaxial connector 14 connected to the input end of the peripheral coaxial line 15. To the contrary, in the third embodiment, the impedance conversion part (¼ wavelength multi-stage-type impedance conversion part or the like) is provided to the peripheral coaxial line 15 so that characteristic impedance of the output end of the peripheral coaxial line 15 is set higher than characteristic impedance of the input end of the peripheral coaxial line 15 and hence, impedance of the input end of the radial line 13 can be set to a high value thus overcoming the above-mentioned drawback.

The reason such a constitution is adopted is that, as expressed in the above-mentioned (formula 1), the height (H) of the radial line 13 and impedance (Z) of the radial line have the proportional relationship. That is, by adopting the constitution of the third embodiment, the height of the input end of the radial line 13 can be set higher and hence, it is possible to prevent a manufacturing (working) error from influencing the characteristic of the radial line 13.

In this manner, the third embodiment can acquire advantageous effects substantially equal to the above-mentioned advantageous effects of the first embodiment. Further, according to the third embodiment, even when the number of combining (N) of the power combiner/divider W1 becomes large, the height of the input end of the radial line 13 can be set high and hence, the occurrence of a manufacturing (working) error can be prevented.

<<Fourth Embodiment>>

Figure 3:
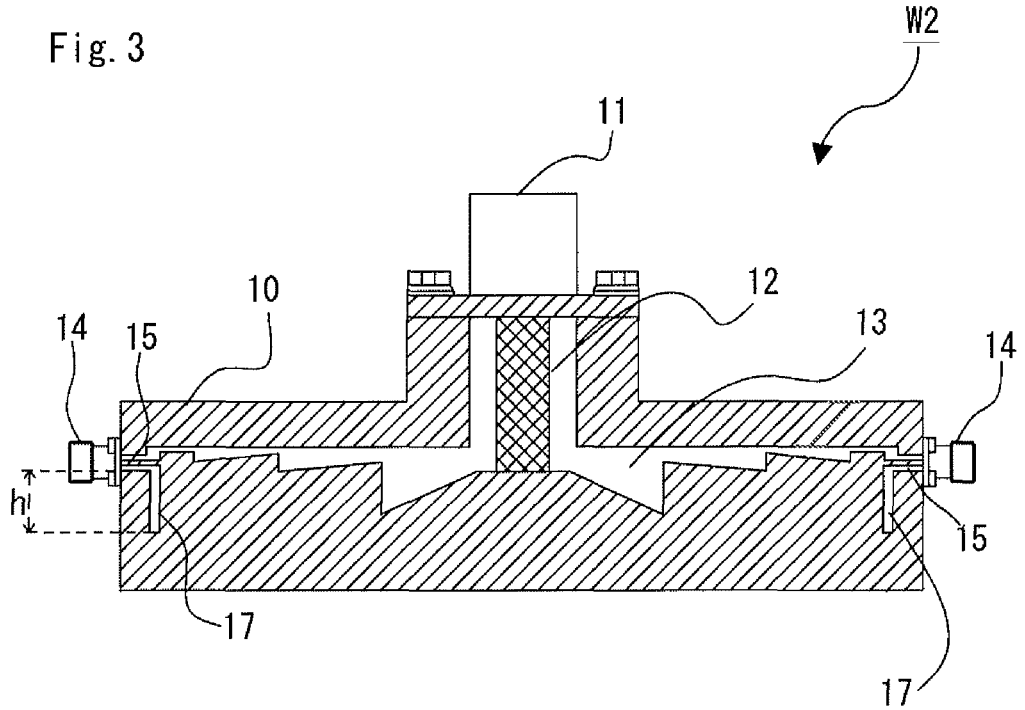
FIG. 3 is a view showing a cross section of a power combiner/divider according to a fourth embodiment of the present invention.
Figure 4:
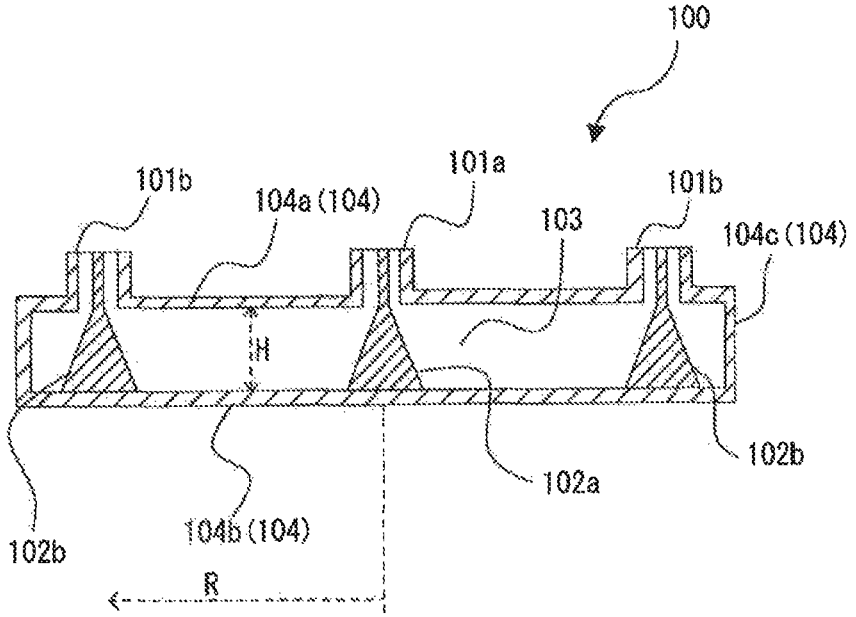
Fig. 4 Related Art
FIG. 4 is a view showing the schematic constitution of a power combiner/divider of a related art which uses a radial line.

Next, the fourth embodiment of the present invention is explained in conjunction with FIG. 3. FIG. 3 is a schematic view showing a cross section of a power combiner/divider according to the fourth embodiment of the present invention. The fourth embodiment is an embodiment obtained by partially modifying the constitution of the first embodiment and hence, for the sake of convenience of explanation, the constitutions of this embodiment identical to (and corresponding to) the constitutions of first embodiment are explained using the same symbols. Further, in the explanation of the fourth embodiment, parts which make this embodiment differ from the first embodiment are explained mainly, while the explanation of the constitution of this embodiment similar to the constitution of the first embodiment is simplified.

As shown in the drawing, in a power combiner/divider W2 of the fourth embodiment, in the vicinity of an outer peripheral portion of an upper surface of a box body portion 11 constituting a body portion 10, a gap portion (high impedance portion) 17 which extends toward a bottom portion from the upper surface is formed at a connecting portion between a peripheral coaxial line 15 and a radial line 13. The constitutions of the fourth embodiment are substantially equal to the constitutions of the first embodiment except for the gap portion 17.

To be more specific, in the power combiner/divider W2 of the fourth embodiment, a height size (h) of the gap portion 17 is set odd times as large as "¼ wavelength" of a microwave or a millimeter wave. Further, an opening portion of the gap portion 17 is in an electrically open state. By constituting the gap portion 17 in this manner, a high impedance part which can ignore impedance at a grounded portion can be formed at a connecting portion with the radial line 13, and the generation of undesired reactance can be prevented since the opening portion of the gap portion is in an electrically open state. Accordingly, by adopting the constitution of the fourth embodiment, the influence (irregularities in performance) exerted by a manufacturing error can be suppressed.

Here, the present invention is not limited to the above-mentioned embodiments (the first embodiment to the fourth embodiment), and various modifications are conceivable without departing from the gist of the present invention.

For example, in this embodiment, although the impedance conversion part is constituted of ¼ wavelength portions in 3 stages in the radial line 13, the impedance conversion part is not limited to such a constitution. For example, in the radial line 13, an impedance conversion part constituted of ¼ wavelength portions in 4 stages or more may be provided, or an impedance conversion part constituted of a ¼ wavelength portion in 1 stage may be provided. Further, although "the ¼ wavelength multi-stage-type impedance conversion part" is provided to the coaxial lines (the center coaxial line 12, the peripheral coaxial lines 15) in this embodiment, this arrangement of the impedance conversion part merely constitutes one example. The impedance conversion part may be formed of a ¼ wavelength portion in 1 stage, for example.

Further, the gap portion 17 of the fourth embodiment may be added to the constitution of the second embodiment, or the gap portion 17 of the fourth embodiment may be added to the constitution of the third embodiment.

REFERENCE SIGNS LIST

W1,W2 . . . power combiner/divider
10 . . . body portion
10*a* . . . lid body portion(body portion)
10*a*1 . . . projecting portion(lid body portion(body portion))
10*b* . . . box body portion(body portion)
11 . . . center coaxial connector
12 . . . center coaxial line
13 . . . radial line
14 . . . peripheral coaxial connector
15 . . . peripheral coaxial line
17 . . . gap portion(high impedance portion)

The invention claimed is:

1. A power combiner/divider comprising:
a body portion in which a cavity is formed;
a center coaxial connector which is formed on an approximately center portion of the body portion;
a plurality of peripheral coaxial connectors which are arranged outside the center coaxial connector concentrically with the center coaxial connector, and are formed on an outer peripheral portion side of the body portion;
a radial line which is formed in the cavity formed in the body portion;
a center coaxial line which has one end thereof connected to the center coaxial connector and the other end thereof connected to a center portion of the radial line; and
a plurality of peripheral coaxial lines each comprising one end thereof connected to a respective one of the plurality of peripheral coaxial connectors and the other end thereof connected to an outer peripheral portion of the radial line,
wherein
the cavity formed inside of the body portion is formed into a cylindrical shape with a circular cross section as viewed in a plan view ranging from a center to the outer peripheral portion of the body portion,
in the radial line, an impedance is proportional to a height of the radial line, and the impedance is inversely proportional to a radial distance from a center of the radial line,
a respective peripheral coaxial line is provided for a corresponding peripheral coaxial connector,
the power combiner/divider
is configured to function as a power combiner when the center coaxial connector is used as an output terminal and the plurality of peripheral coaxial connectors are used as respective input terminals, and
is configured to function as a power divider when the center coaxial connector is used as an input terminal and the plurality of peripheral coaxial connectors are used as a respective output terminals, and
an impedance conversion part is provided to the radial line in one or plural stages, and the impedance conversion part is configured to perform impedance matching between the center coaxial connector and the plurality of peripheral coaxial connectors.

2. The power combiner/divider according to claim 1, wherein a high impedance part is arranged at a respective connecting portion between the plurality of peripheral coaxial lines and the radial line.

3. The power combiner/divider according to claim 1, wherein the impedance conversion part is provided to said each peripheral coaxial line in one or plural stages.

4. The power combiner/divider according to claim 3, wherein a high impedance part is arranged at a respective connecting portion between the plurality of peripheral coaxial lines and the radial line.

5. The power combiner/divider according to claim 1, wherein the impedance conversion part is provided to the center coaxial line in one or plural stages.

6. The power combiner/divider according to claim 5, wherein a high impedance part is arranged at a respective connecting portion between the plurality of peripheral coaxial lines and the radial line.

7. The power combiner/divider according to claim 5, wherein the impedance conversion part is provided to said each peripheral coaxial line in one or plural stages.

8. The power combiner/divider according to claim 7, wherein a high impedance part is arranged at a respective connecting portion between the plurality of peripheral coaxial lines and the radial line.

* * * * *